US005467823A

United States Patent [19]

Babour et al.

[11] Patent Number: 5,467,823

[45] Date of Patent: Nov. 21, 1995

[54] METHODS AND APPARATUS FOR LONG TERM MONITORING OF RESERVOIRS

[75] Inventors: Kamal Babour, Bures sur Yvette, France; Ashok K. Belani, Dubai, United Arab Emirates; Jacques Pilla, Saint Remy Les Chevreuse, France

[73] Assignee: Schlumberger Technology Corporation, Houston, Tex.

[21] Appl. No.: 340,973

[22] Filed: Nov. 17, 1994

[30] Foreign Application Priority Data

Nov. 17, 1993 [FR] France ..... 93 13719

[51] Int. Cl.[6] ..... E21B 43/00

[52] U.S. Cl. ..... 166/250.01; 166/297

[58] Field of Search ..... 166/250, 253, 166/254, 255, 66, 55, 281, 285, 286, 299

[56] References Cited

U.S. PATENT DOCUMENTS 4,475,591 10/1984 Cooke, Jr. .
4,548,266 10/1985 Burklund .
5,044,437 9/1991 Wittrisch ..... 166/250
5,302,780 4/1994 Hanson, III ..... 166/250 X

FOREIGN PATENT DOCUMENTS 8503105 7/1985 France .
2682715 4/1993 France .

*Primary Examiner*—Michael Powell Buiz
*Attorney, Agent, or Firm*—Henry N. Garrana; John H. Bouchard

[57] ABSTRACT

A method and apparatus of monitoring subsurface formations containing at least one fluid reservoir and traversed by at least one well, by means of at least one sensor responsive to a parameter related to fluids, comprising the steps of:

lowering the sensor into the well to a depth level corresponding to the reservoir;

fixedly positioning said sensor at said depth while isolating the section of the well where the sensor is located from the rest of the well and providing fluid communication between the sensor and the reservoir.

28 Claims, 3 Drawing Sheets

METHODS AND APPARATUS FOR LONG TERM MONITORING OF RESERVOIRS

The present invention concerns methods and installations for monitoring a reservoir of fluids such as hydrocarbons located in subsurface formations traversed by at least one well. The invention also relates to devices suitable for the implementation of such methods and specifically on a long term basis.

During the production of fluids such as hydrocarbons and/or gas from an underground reservoir, it is important to determine the development and behavior of the reservoir, firstly to allow production to be controlled and optimized and secondly to foresee changes which will affect the reservoir, in order to take appropriate measures.

Methods and devices for determining the behavior of under ground reservoirs, by measuring the pressure of fluids, are well known in the prior art.

A first such method consists in locating a pressure gauge at the bottom of a production well and connecting it to the surface by a cable or other communication means allowing transmission of information between the gauge and the surface.

That known method suffers from certain problems. In the first place, the pressure gauge located at the bottom of the well and its associated devices are very costly; for example, often this cost approaches the same order as that of the production well itself. Moreover the pressure gauge in such a position at the bottom of the well only allows the pressure in the well to be measured, in the course of production.

In a second known method, called "interference testing", pressure is measured with the aid of at least two wells spaced from one another and penetrating the production region which is isolated above and below by plug members known as "packers". One or more pressure gauges are located in the production region, in each of the wells. A pressure pulse is then generated in one of the wells and the variation of pressure with time as a result of this pressure pulse, is measured in the other well.

Although it provides valuable data, this interference method also suffers from problems. Firstly, it is very costly because it is necessary to stop production of the well in which the measurement is made and taking a set of measurements can last several days. That is all the more true insofar as it is necessary to stop all the wells in a region of measurement. Furthermore that method is only possible in existing wells and thus requires at least two wells drilled in the same production region.

Finally, those known methods only allow measurements in the production well. It is thus necessary to carry out interpolations, extrapolations and complex calculations in an attempt to determine the behavior of the reservoir from these measurements. In other words, these measurements do not allow the behavior of the reservoir itself to be determined, this being all the more true for the regions of the reservoir remote from the production wells where the measurements are made.

The present invention provides a method of monitoring subsurface formations containing at least one fluid reservoir and traversed by at least one well, by means of at least one sensor responsive to a parameter related to fluids, comprising the steps of:

lowering the sensor into the well to a depth level corresponding to the reservoir;

fixedly positioning said sensor at said depth while isolating the section of the well where the sensor is located from the rest of the well and providing fluid communication between the sensor and the reservoir.

In a preferred implementation, said parameter is the pressure of the fluid in the reservoir.

According to another aspect, the invention also provides a device for monitoring an underground fluid reservoir traversed by at least one well, comprising at least one sensor responsive to a property of fluids and means capable of perforating a cement layer for providing a channel therein allowing fluid communication between said sensor and the reservoir.

According to a further aspect, the invention provides a long term installation for monitoring an underground fluid reservoir traversed by at least one well, comprising at least one sensor responsive to a property of fluids, fixedly positioned at a depth of interest in the well by cementing to a region of the well said sensor. At least one channel in said cemented region providing fluid communication between said sensor and the reservoir, and means for transmitting electrical signals between said sensor and the surface.

The invention will be better understood in the light of the following description relating to illustrative, non-limiting examples, in conjunction with the,accompanying drawings, in which.

Figure 1:
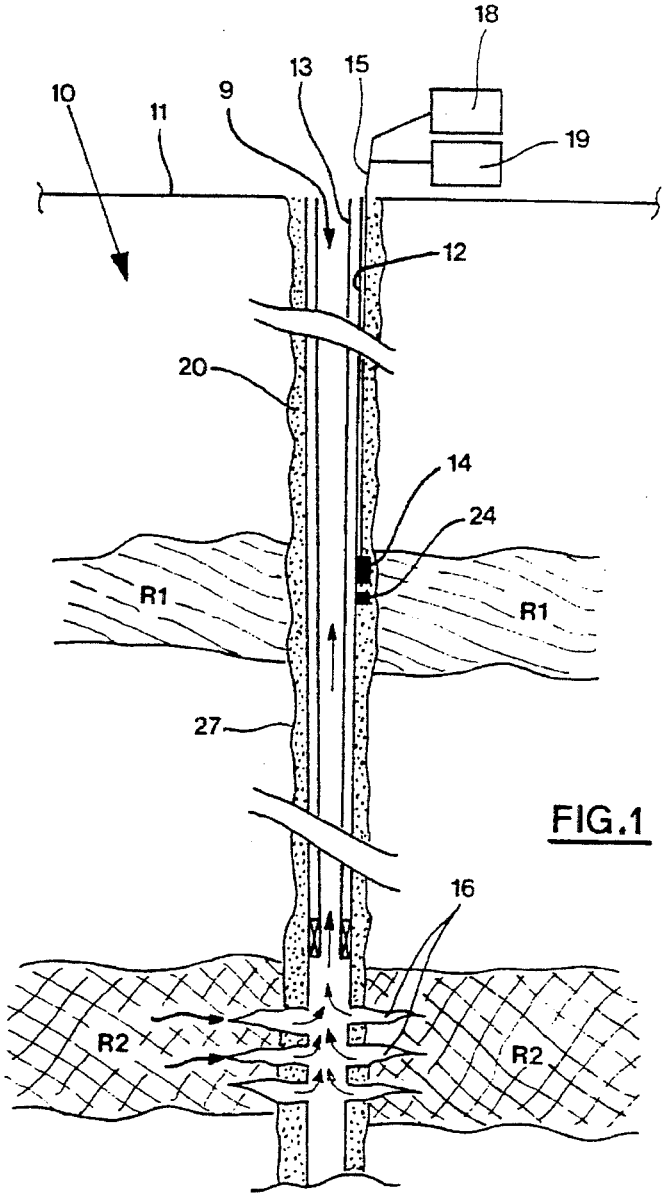
FIG. 1 is a schematic representation of an installation according to a first embodiment of the invention.

As shown in FIG. 1, a production well 9 penetrates ground formations 10 whose surface carries the reference 11. The formations 10 include first and second hydrocarbon reservoirs R1 and R2. The well 9 is fitted with casing 12 and a production string 13 known per se and concentric with the casing, for allowing the fluid (hydrocarbons and/or gas) to flow from the production region (reservoir R2) to the surface.

Reservoir R1 does not produce fluid through the production well 9; only the fluid from reservoir R2 flows (as symbolized by the arrows) by way of perforations 16 to the interior of the production string 13.

A pressure sensor such as a pressure gauge 14, known per se, is fixed on the outer surface of the casing 12 at a depth corresponding to the non-producing reservoir R1 in the well 10. This gauge is connected to the surface 11 by way of a cable 15 running along and outside the casing. The cable 15 is connected at the surface both to a power supply unit 18 and to an acquisition and control system 19 adapted to send and receive information and commands in the form of electrical signals respectively to and from the pressure gauge 14. The acquisition and control system 19 and the power supply unit 18 are known per se and need not be described here.

The sensor or pressure gauge 14 is located in a permanent manner on the outer wall of the casing 12. Once the casing 12 has been lowered in the well so as to position the gauge at the desired depth, cement 20 is injected in known manner into the annular space between the outer face of the casing and the wall 27 of the well.

For enabling the pressure of the fluid in reservoir R1 traversed by the well to be measured, provision is made to place the pressure gauge in fluid communication with the reservoir R1.

In one embodiment, the gauge is put in communication with the fluids in the reservoir under remote control from the surface, by means of a perforating device including a directional explosive charge positioned near the gauge. However, the pressure gauge 14 remains isolated from the fluid flowing into the string 13 from the producing reservoir R2.

Only one sensor 14 and only one well are shown in FIG. 1. A plurality of wells and of gauges may be provided in such a manner as to increase the coverage of the reservoir R1.

Figure 2:
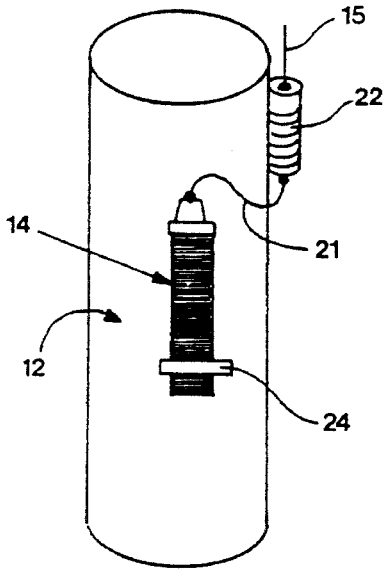
FIG. 2 is a schematic view of a device used in the installation of FIG. 1.

FIG. 2 is a detail view of the casing 12 and the device of FIG. 1, comprising a pressure gauge 14, shown symbolically and fixed to the outer wall of the casing 12. An electrical connection 21 is provided between the pressure gauge and an electronic interface 22 allowing the pressure gauge to be energized and to transmit information and command signals from and to the gauge. The interface 22 is within the purview of those skilled in the art and needs not be described in detail. It is connected to cable 15, whose upper end is connected at the surface to the acquisition unit 19 and the power supply unit 18 (FIG. 1). The cable 15 is fixed against the outer wall of the casing 12 as well as the electronic interface 22.

A perforating device comprising a directional explosive charge, schematically shown at 24, is provided adjacent the base of the pressure gauge. Its firing is controlled from the surface via the interface 22 and the cable 15.

Figure 3:
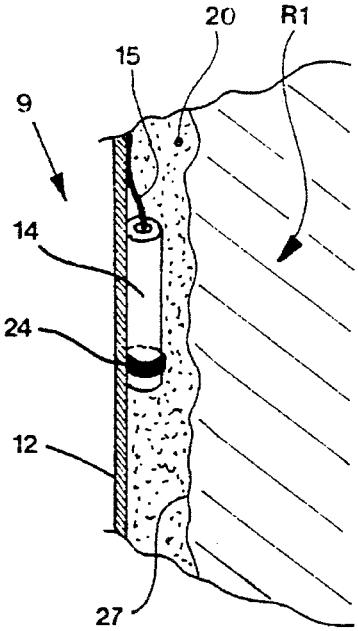
FIG. 3 is a schematic view of a section of the well equipped with the device of FIG. 2.

FIG. 3 shows schematically the arrangement in the well of the pressure gauge and the associated perforating device. The gauge 14 is fixed by any known means to the outer wall of the casing 12. The perforating device 24 is fixedly positioned adjacent the pressure gauge. Cement 20 is injected between the outer wall of the casing 12 and the wall 27 of the well 9 penetrating the reservoir R1.

Figure 4:
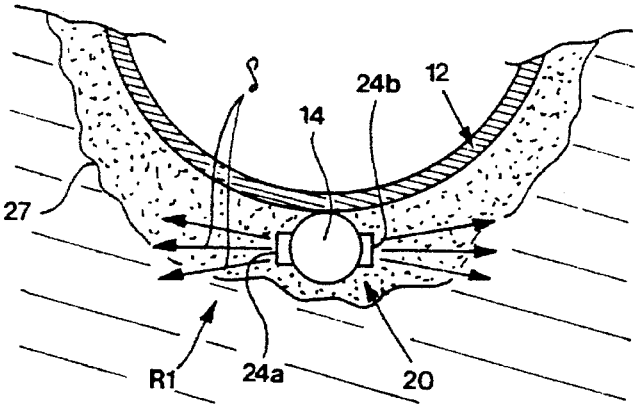
FIG. 4 is a schematic transverse section of the operation of an explosive perforating device included in the device of FIG. 2, in one embodiment.

FIG. 4 shows, in a schematic cross-section (transverse to the longitudinal axis of the well) an embodiment for the arrangement of the pressure gauge and the perforating device. The latter is disposed in such a manner as to direct the energy resulting from the explosion in a direction which forms an angle with the corresponding diameter of the casing, and which is preferably substantially tangential to the casing 12 as shown in FIG. 4, in order to minimize the risks of damage to the casing. This may be desirable especially when a casing of plastics is to be used.

That direction is also suitably transverse to the longitudinal axis of the casing. The arrows f symbolize the energy flux resulting from the explosion, resulting in a "jet" which perforates the cement at this point and penetrates into the ground formation in the region proximate to the wall 27 of the well. This places the fluids in reservoir R1 in communication with the pressure gauge 14. As shown in FIG. 4, the perforating device may comprise two explosive charges 24*a* and 24*b*, suitably shaped charges, releasing energy in two opposite directions along the same tangent. The pressure gauge is thus put into communication with the reservoir R1.

It will be noted, however, t:hat in circumstances where damage to the casing is not a concern, a radial direction of perforation is preferable because this optimizes the efficiency of the perforation. As a matter of fact, if the energy is directed radially with respect to the casing, the thickness of the cement layer to be perforated is minimized. Accordingly the depth of penetration of the perforating "jet" into the formation is maximized.

Figure 5:
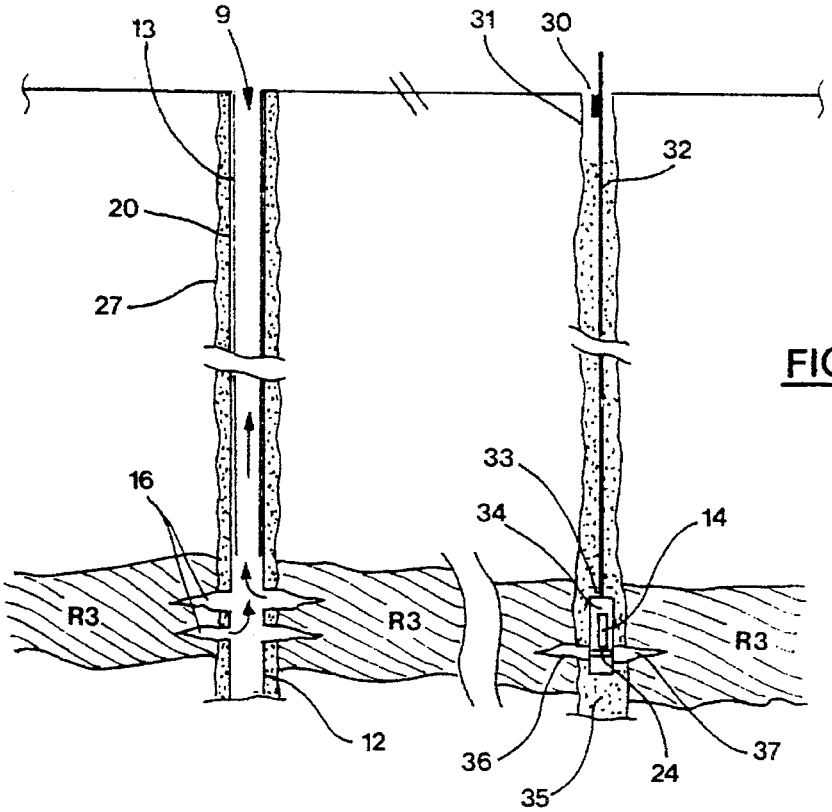
FIG. 5 shows an installation according to a second embodiment of the invention.

Another embodiment of the invention is shown in FIG. 5, in which like parts have the same references as in FIGS. 1 to 4.

A production well 9 fitted with casing 12 and a production tubing 13 traverses a hydrocarbon reservoir R3; cement 20 is injected between the outer wall of the casing 12 and the wall 27 of the well. Perforations 16 allow the fluid of the reservoir to flow into the well and the interior of the column 13.

A well 30 drilled at some distance away (between some tens of meters and some kilometers for example) also traverses reservoir R3. Only the upper part of the well 30 is provided with casing 31 (to a depth which depends on the location of reservoir R3 and the conditions of the well), the remainder of the well being left "open" i.e. without casing. A measuring device 33 suspended from a cable 32 is lowered into the well. This device comprises a tube 34 (such as a section of casing) with a pressure gauge 14 and a directional perforating device 24 secured to the outer wall thereof. The tube 34 can enclose an electronic device associated with the gauge.

Cement 35 is injected into the well to a depth corresponding to the reservoir R3, in such a manner that the measuring device 33 is fixed in permanent manner in the well and so as to prevent fluid ingress from the reservoir R3 into the well 30. Well 30 forms an observation well while well 9 is for production.

Firing of the explosive charge 24 in the manner described above creates perforations 36, 37 adapted to put the fluid of the reservoir R3 into communication with the pressure gauge 14. The fluid to which the pressure gauge is exposed does not enter the observation well 30.

Figure 6A:
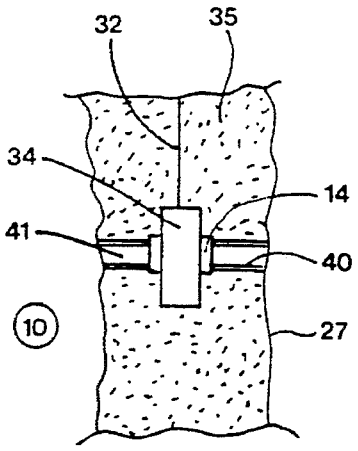
FIGS. 6A and 6B are schematic views showing variant embodiments.

In a first variant, shown schematically in FIG. 6A, communication is ensured between the reservoir and the sensor by means of hollow members 40 associated with the sensor which define channels 41 providing fluid communication between the sensor and the reservoir.

The communicating channels 41 thus created are protected by members 40 during cementing. This embodiment avoids the use of explosives.

Figure 6B:
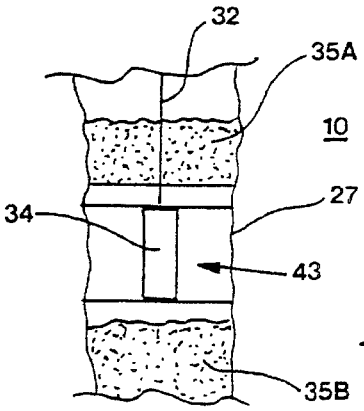

A second variant, shown in FIG. 6B, shows two cylindrical masses or "plugs" of cement 35A and 35B respectively, filling the well both above and below the region or section 43 of the well where the sensor 34 is located. The reservoir 10 is in communication, in the hydraulic sense, with the section 43 and thus with the sensor 34. The section 43 is isolated from the rest of the well by the upper and lower "plugs" of cement 35A and 35B respectively.

Figure 7:
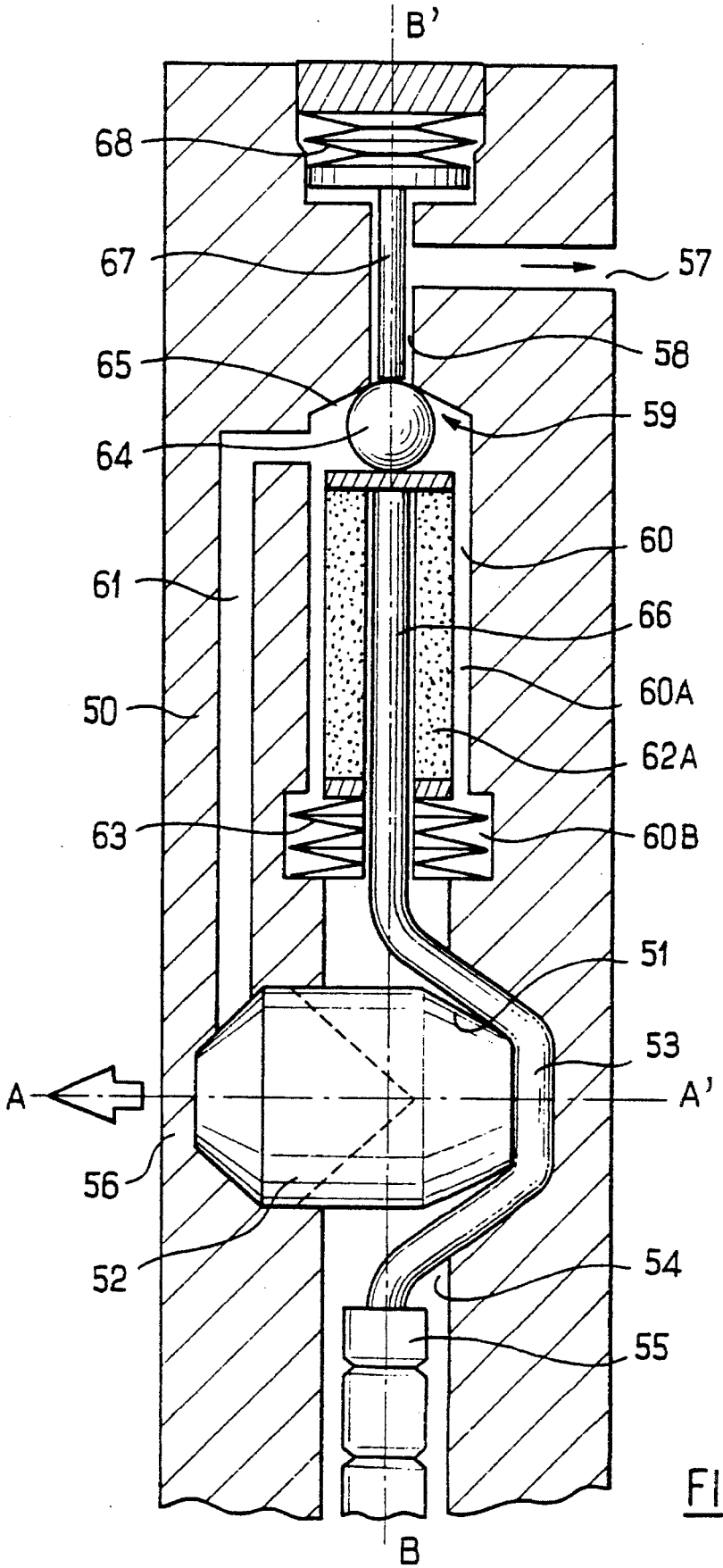
FIG. 7 shows an embodiment of a perforating device in accordance with the invention.

FIG. 7 shows in more detail an embodiment of a perforating device according to the invention, suitable: for use in conjunction with a permanently installed pressure gauge.

The device comprises an elongate housing 50 e.g. of steel, adapted to be secured to the outer wall of a casing. The housing 50 has a substantially cylindrical recess 51 for receiving a shaped charge schematically shown at 52 and a detonating cord 53, said recess having an axis A–A' orthogonal to the longitudinal axis B–B' of the housing 50. The arrow on FIG. 7 indicates that axis A–A' is the direction of perforation. Also provided in housing 50 is a passage 54 having axis B–B' as its axis and connected to recess 51 on one side thereof. Passage 54 accommodates a detonator 55 connected in use to a cable through which a firing signal from the surface equipment can be applied to the detonator 55.

The detonating cord 53 is secured to the rear end portion of the shaped charge 52. The wall portion 56 of the housing 50 facing the front end of the shaped charge has a reduced thickness to minimize the energy required for its perforation.

The housing 50 has a pressure port 57 intended for connection to a pressure gauge, not shown. Port 57 communicates with recess 51 receiving a shaped charge through channel 58, a valve 59 and parallel passages 60, 61 provided in housing 50 and extending in the longitudinal direction thereof, which passages open into recess 51 on its side opposite to passage 54. Passage 60 is in the shown embodiment aligned with passage 54 and channel 58, i.e. these passages have axis B–B' as their central axis while passage 61 is laterally offset from axis B–B'. Passage 60 has a section 60A receiving a tubular piston 62A, and a section 60B of larger diameter receiving a spring member 63 e.g. a stack of Belleville washers, which urges piston 62A into engagement with the valve member 64 of valve 59 to apply the valve member against valve seat 65, so as to keep valve 59 in its closed position.

The detonating cord 53 has an extension 66 which is inserted in the central bore of piston 62A, and piston 62A is made of a brittle material such as cast iron which will shatter and produce debris upon firing of the cord extension 66.

A counter-piston 67 mounted in channel 58, of smaller cross-section than piston 62A, is urged by a spring member 68 e.g. a stack of Belleville washers into engagement with valve member 64 on the side thereof opposite to passage 60.

The operation of this device is as follows. Before firing, the valve 59 is held in its closed position as explained above. Initial pressure in channel 58, passages 60 and 61 is the atmospheric pressure. When the detonator 55 is activated by a command signal from the surface, the cord 53 fires the shaped charge 52 which perforates the steel wall 56 of the housing and the cement layer (not shown on FIG. 7) filling the space between the housing and the wall of the well, and penetrates into the region of the formation adjacent the wall of the well. Recess 51 and passages 60, 61 are thus exposed to the fluids present in the formation. The extension 66 of detonating cord is fired and its detonation shatters piston 62A. The over-pressure resulting from the explosion of the shaped charge and the detonating cord replaces the action of piston 62A and spring member 63 in that it applies valve member 64 against its seat 65, thereby keeping the valve in its closed position and protecting the pressure gauge connected to port 57 against such over-pressure.

Thereafter, it takes a period of time for the over-pressure to disappear. Once this is completed, the counter-piston 67 biased by spring member 68 can displace the valve member 64 from its closed position and thereby communicate the port 57 connected to the pressure gauge to passages 60, 61 and to the reservoir, thus allowing the pressure gauge to measure the pressure of the reservoir fluids. At this point, passage 61 provides a safe communication as passage 60 may be obstructed by debris.

We claim:

1. A method of monitoring subsurface formations containing at least one fluid reservoir and traversed by at least one well, comprising the steps of:

providing one sensor responsive to a parameter related to fluids;

lowering the sensor into the well to a depth level corresponding to the reservoir;

fixedly positioning said sensor at said depth while isolating the section of the well where the sensor is located from the rest of the well;

providing fluid communication between the sensor and the reservoir; and establishing communication between the sensor and the surface.

2. A method according to claim 1, comprising the steps of cementing the well at least in the portion where the sensor is located, to fix the sensor in the well.

3. A method according to claim 2, wherein fluid communication is provided by perforating the cement.

4. A method according to claim 3, wherein said perforating is effected by firing at least one directional explosive charge.

5. A method according to claim 4, wherein said perforating is effected in a substantially radial direction with respect to the well.

6. A method according to claim 4, wherein said perforating is effected in a direction substantially tangential with respect to the well.

7. A method according to claim 5 or claim 6, wherein said perforating is effected in a plane substantially orthogonal to the axis of the well.

8. A method according to claim 3, wherein said perforating is effected at a level longitudinally spaced from the level of the sensor.

9. A method according to claim 8, further including the step of protecting the sensor against over-pressure resulting from said perforating.

10. A method according to claim 9, comprising the step of putting the sensor into communication with the reservoir only after said over-pressure has disappeared.

11. A method according to claim 10 further comprising the steps of having a casing put in place in the well with said sensor fixed on its outer wall, and said cementing step includes injecting cement into the annular space between the casing and the wall of the well.

12. A method according to claim 4 further comprising the step of having a casing put in place in the well with said sensor and said explosive charge fixed on its outer wall, and said cementing step includes injecting cement into the annular space between the casing and the wall of the well.

13. A method according to claim 12, in which said sensor is lowered into the well by means of a cable, and the well is cemented over its entire cross-section.

14. A method according to claim 2, wherein said sensor is lowered into the well by means of a cable, and the well is cemented over its entire cross-section in the region of the sensor while channels between the sensor and the wall of the well are protected against ingress of cement to provide fluid communication between the sensor and the reservoir.

15. Apparatus for monitoring subsurface formations containing at least one fluid reservoir and traversed by at least one well, comprising:

a sensor responsive to a parameter related to fluids;

said sensor being positioned in the well to a depth level corresponding to the reservoir;

means for fixedly positioning said sensor at said depth while isolating the section of the well where the sensor is located from the rest of the well;

means for providing fluid communication between the sensor and the reservoir; and means for establishing communication between the sensor and the surface.

16. Apparatus according to claim 15, comprising means for cementing the well at least in the portion where the sensor is located, to fix the sensor in the well.

17. Apparatus according to claim 16, further comprising a perforating means and wherein fluid communication is provided by perforating the cement.

18. Apparatus according to claim 17, wherein said perforating means includes at least one directional explosive charge.

19. Apparatus according to claim 18, wherein said perforating is effected in a substantially radial direction with respect to the well.

20. Apparatus according to claim 18, wherein said perforating is effected in a direction substantially tangential with respect to the well.

21. Apparatus according to claim 19, wherein said perforating is effected in a plane substantially orthogonal to the axis of the well.

22. Apparatus according to claim 17, wherein said perforating is effected at a level longitudinally spaced from the level of the sensor.

23. Apparatus according to claim 22, further including the step of protecting the sensor against over-pressure resulting from said perforating.

24. Apparatus according to claim 23, comprising means for putting the sensor into communication with the reservoir only after said over-pressure has disappeared.

25. Apparatus according to claim 24 further comprising: a casing put in place in the well with said sensor fixed on its outer wall, and said means for cementing includes means for injecting cement into the annular space between the casing and the wall of the well.

26. Apparatus according to claim 18 further comprising: a casing put in place in the well with said sensor and said explosive charge fixed on its outer wall, and said cementing means includes means for injecting cement into the annular space between the casing and the wall of the well.

27. Apparatus according to claim 16, in which said sensor is lowered into the well by means of a cable, and the well is cemented.

28. Apparatus according to claim 27, wherein said sensor is lowered into the well by means of a cable, and the well is cemented over its entire cross-section in the region of the sensor while channels between the sensor and the wall of the well are protected against ingress of cement to provide fluid communication between the sensor and the reservoir.

* * * * *